United States Patent [19]

Miller

[11] Patent Number: 4,488,854

[45] Date of Patent: Dec. 18, 1984

[54] CONSTRAINED WAVE PUMP

[76] Inventor: Richard B. Miller, R.R. 2, Box 723, Spencer, Ind. 47460

[21] Appl. No.: 367,375

[22] Filed: Apr. 12, 1982

[51] Int. Cl.[3] ..... F04B 19/22; F04B 21/04

[52] U.S. Cl. ..... 417/241; 417/555 R

[58] Field of Search ..... 417/240, 555; 128/1 D

[56] References Cited

U.S. PATENT DOCUMENTS

| | | | |
|---|---|---|---|
| 3,021,793 | 2/1962 | Bolstad | 417/555 |
| 3,597,126 | 8/1971 | Brumbaugh | 417/555 |
| 3,743,446 | 7/1973 | Mandroian | 417/240 |

*Primary Examiner*—William L. Freeh

*Attorney, Agent, or Firm*—Woodard, Weikart, Emhardt & Naughton

[57] ABSTRACT

A constrained wave pump for pumping fluids by oscillation of an elastic medium. Coaxially arranged cylindrical constraining surface and elastic member define a channel having an entrance and an exit port. A shaft creates variable frequency longitudinal oscillations in the elastic member which generate wave propagation therein. The peaks of the generated waves form a fluid seal with the constraining surface to produce a fluid pumping action from the entrance to the exit port.

2 Claims, 6 Drawing Figures

CONSTRAINED WAVE PUMP

BACKGROUND OF THE INVENTION

1. Field of the Invention:

The present invention relates to pumps for transporting fluids. The present invention also relates to devices employed to harness wave energy.

2. Description of the Prior Art:

Devices are known in the prior art which utilize wave energy. For example, both U.S. Pat. No. 960,478 issued June 7, 1910 to Allard and U.S. Pat. No. 1,008,683 issued Nov. 14, 1911 to Wall use ocean waves to compress air. Both of these devices use a type of horizontal funnel to channel ocean waves. The air trapped between the waves and the top of a funnel is compressed as it is pushed to the narrower rear part of the funnel by the travelling ocean waves. In leaving the rear of the funnel, the compressed air passes valves and enters storage tanks or the like.

Similarly, U.S. Pat. No. 4,022,549 issued May 10, 1977 to Gregg describes a shoreline air compressor shaped as a dome. A funnel compresses an incoming wave or swell, as described in the above patents, to compress the air. A series of pulleys actuate gates to allow the wave to dissipate through radial ports after the air is compressed. In this way the next incoming wave is not interefered with by reflection of the prior wave.

While perhaps not prior art, the device in U.S. Pat. No. 4,170,738 issued Oct. 9, 1979 to Smith takes advantage of the elliptical motion of water molecules beneath the ocean surface. A sail is submerged and moved back and forth in a reciprocating fashion by the water's motion. The sail connects to a generator to produce electric current.

Each of the above devices harnesses wave energy produced in nature. Another simpler, and more commonly known device which takes advantage of wave energy is the surf board. The surf board is used as an aid in the recreational pastime of using ocean wave movement as a means of propelling a surf board rider towards the shore.

In the art of mechanically operated fluid pumps, there are a wide variety of such pumps that have been devised. However, they generally incorporate standard seals and valves and do not utilize the unique benefits available from wave energy as are hereinafter described.

SUMMARY OF THE INVENTION

In the present invention, a novel constrained wave pump employs oscillation of a wave medium to pump a fluid through a channel formed between said wave medium and a constraining surface. Of course, while the actual nature of the invention covered herein can be determined only with reference to the claims appended thereto, certain features which are characteristic of the preferred embodiment of the novel constrained wave pump disclosed herein can be described briefly.

One object of the present invention is to provide a new and simple means for pumping fluids which reduces the need for complicating seals and valves to produce workable efficiencies.

Another object of the present invention is to transfer energy from the oscillation of an elastic wave medium to linear motion of an adjacent fluid.

Still other objects will become apparent from the disclosure and claims herein.

DESCRIPTION OF THE PREFERRED EMBODIMENT

Figure 1:
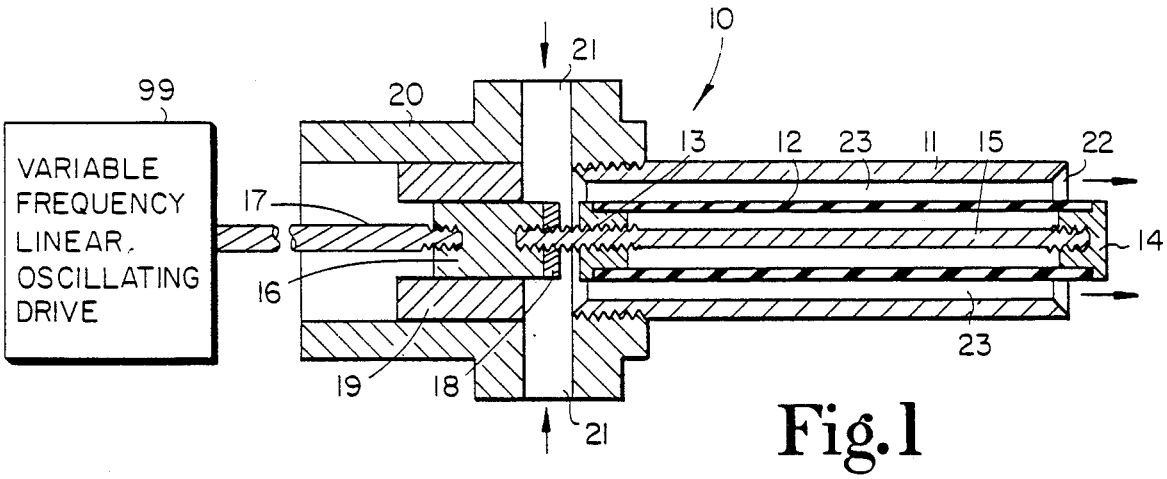
FIG. 1 is a cross section view of the preferred constrained wave pump.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, the preferred constrained wave pump 10 may be described beginning with a cylindrical constraining surface 11 having external threads at one end. A cylindrical elastic member 12 is arranged coaxially with constraining surface 11; while internally threaded annular member 13 and annular plug 14 loosely secure the ends of elastic member 12 to the outer surfaces thereof. Oscillating shaft 15 has externally threaded ends threadably engaged with member 13 and plug 14, extends through member 13 and plug 14, and is coaxially arranged with elastic member 12.

Cylindrical joint 16 contains an internally threaded cylindrical aperture at either end; one aperture of which is threadably engaged with that end of shaft 15 extending beyond annular member 13. Internally threaded lock nut 18 locks shaft 15 to joint 16 by threadably engaging shaft 15 immediately adjacent to joint 16. An externally threaded oscillating drive member 17 is threadably engaged with the other aperture of joint 16, and is driven in a longitudinal oscillatory motion by an external drive means (generally shown in FIG. 1 as Variable Frequency Linear Oscillating Drive 99). Thus, it is apparent that longitudinal oscillation of drive member 17 results in the same oscillation of joint 16, lock nut 18, shaft 15, annular member 13, plug 14, and finally elastic member 12.

Annular bushing 19 is fitted adjacent with and coaxially about joint 16 and has a low coefficient of friction to allow relative motion therebetween. Generally, cylindrical pump housing 20 is in turn fitted adjacent with and about bushing 19, and has internal threads at one end threadably engaged with cylindrical constraining surface 11, maintaining surface 11 in the coaxial arrangement with elastic member 12. Radial entrance ports 21 in housing 20 and exit port 22 provide access of a fluid to channel 23 between elastic member 12 and constraining surface 11.

Figure 2:
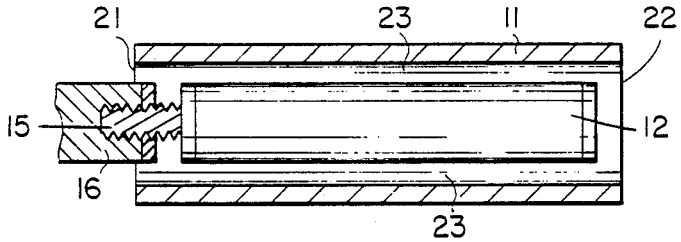
FIG. 2 is a partial cross section and elevation view of the elastic member and constraining surface prior to wave propagation.
Figure 3:
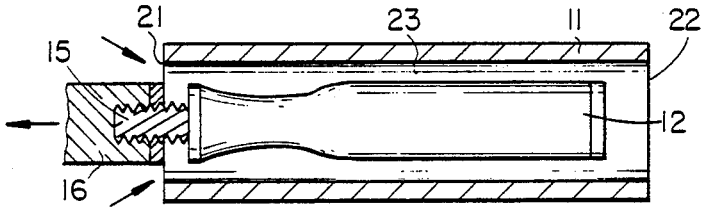
FIG. 3 shows the pump of FIG. 2 but with the beginning of longitudinal oscillation of and wave propagation along the elastic member.
Figure 4:
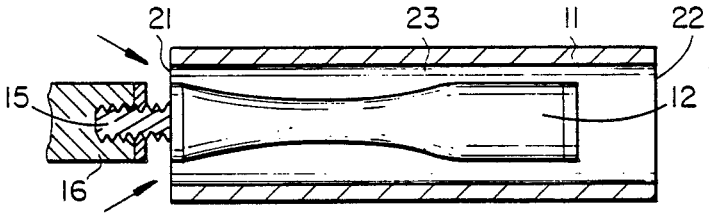
FIG. 4 shows the pump slightly later when the wave propagation is producing further fluid influx.

FIGS. 2 through 6 symbolically display the operation of the preferred pump and are simplified to more clearly reveal the principle underlying the pump. In each figure, cylindrical constraining surface 11 is coaxial with cylindrical elastic member 12, which is secured at both ends and is driven by shaft 15, joint 16 and drive member 17 in a longitudinal oscillation. A fluid (not shown) is present in the pump. FIG. 2 shows the pump in a quiescent mode with no deformation of elastic member 12. FIG. 3 shows the beginning of a longitudinal oscillation or stroke of shaft 15. Here, the shaft 15 is moving to the left and creating a wave trough, from stretching of member 12, which is propagating to the right. This trough creates a lower pressure area of lower density fluid into which is drawn additional fluid. FIG. 4 shows the end of the leftward stroke with the wave trough still propagating to the right. At this point, fluid is still being drawn into the pump, mostly from the left.

Figure 5:
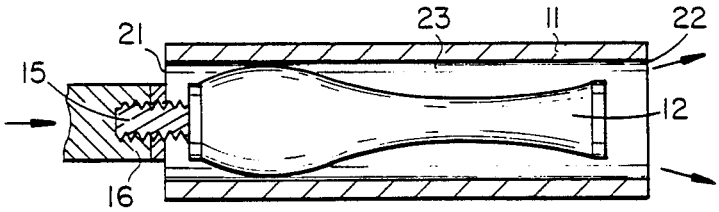
FIG. 5 shows the pump after longitudinal motion of the elastic member has reversed and begun a fluid pumping action.
Figure 6:
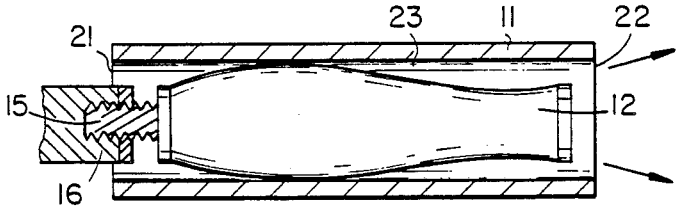
FIG. 6 shows the end of a longitudinal stroke or oscillation where fluid pumping action is continuing.

FIG. 5 shows shaft 15 moving to the right and creating a bulge or wave peak in elastic member 12. As the trough moves to the right, the wave peak against the constraining surface 11 creates a fluid seal and this peak will follow preventing a backflow of the fluid, and pushing the fluid to the right. FIG. 6 shows continued fluid pumping action, as the wave peak travels within elastic member 12 and along channel 23. The generated wave continues within elastic member 12, eventually pushing fluid out exit port 22. Further strokes create additional waves which propagate within elastic member 12 and along channel 23, thereby generating a continuous pumping action from entrance ports 21 toward exit port 22.

Variable frequency linear oscillating device 99 drives elastic member 12 at variably selectable oscillating frequencies. Any of numerous available drive mechanisms may be used for this purpose. By appropriately selecting the oscillation frequency and the length of the oscillating stroke, the rate of pumping can be selectively controlled.

Of course, the range of oscillation frequencies available for efficient pumping will vary depending upon the particular wave medium used, and its relative configuration with the wave constraining surface, and a wide variety of wave mediums, pumping configurations, and oscillation frequencies may be employed for various applications of the present invention. Other embodiments of the present invention might employ a transverse oscillation applied to the wave medium rather than a longitudinal one. Planar or other non-cylindrical surfaces might be substituted for the cylindrical structure disclosed in the drawings. For instance, a conical configuration may be selected to pump a lower volume at higher pressures. Thus, while the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A constrained wave fluid pump comprising:

(a) a hollow tubular member, the interior of said hollow tubular member defining a wave constraining surface;

(b) an elastic wave medium, said elastic medium including a cylindrical member which is concentrically positioned inside said hollow tubular member, said elastic wave medium and said wave constraining surface defining a channel therebetween, said channel having an entrance port and an exit port; and (c) wave generation means for generating waves in said elastic wave medium, the peaks of said waves forming fluid seals with said wave contraining surface to cause a fluid pumping action in said channel from said entrance port to said exit port.

2. A constrained wave fluid pump comprising:

(a) a wave medium, a hollow tubular member, the interior of said hollow tubular member defining a wave constraining surface;

(b) a wave medium, said wave medium including a cylindrical member which is concentrically positioned inside said hollow tubular member, said wave medium and said wave constraining surface defining a channel therebetween, said channel having an entrance port and an exit port; and (c) wave generation means for generating waves in said elastic wave medium, the peaks of said waves forming fluid seals with said wave constraining surface to cause a fluid pumping action in said channel from said entrance port to said exit port, said controllable wave generating means including variable frequency oscillator means for oscillating said wave medium at a selectively controlled frequency.

* * * * *